US005789663A

United States Patent [19]

Boger

[11] Patent Number: 5,789,663

[45] Date of Patent: Aug. 4, 1998

[54] POROUS MEDIUM TEST WITH TRACER RECHARGING AND DISCHARGING THROUGH A SINGLE WELL

[76] Inventor: Michael Boger, 12 Haarava, 46309 Herzelya, Israel

[21] Appl. No.: 866,370

[22] Filed: May 30, 1997

[51] Int. Cl.[6] ..... E21B 49/00

[52] U.S. Cl. ..... 73/38; 73/152.41; 73/52.18; 166/252.1

[58] Field of Search ..... 73/38, 152.41, 73/152.39, 152.46, 152.18; 166/252.1, 274, 250.01, 254, 250, 252

[56] References Cited

U.S. PATENT DOCUMENTS

| | | | |
|---|---|---|---|
| Re. 27,272 | 1/1972 | Young | 250/43.5 |
| 3,690,167 | 9/1972 | Chase, Jr. et al. | 73/155 |
| 3,766,388 | 10/1973 | Greaney | 250/266 |
| 3,799,261 | 3/1974 | Deans et al. | 166/250 |
| 3,990,298 | 11/1976 | Deans | 73/155 |
| 3,993,131 | 11/1976 | Riedel | 166/252 |
| 4,055,399 | 10/1977 | Parrish | 23/230 EP |
| 4,495,805 | 1/1985 | Dowling et al. | 73/155 |
| 4,559,818 | 12/1985 | Tsang et al. | 73/154 |
| 5,079,948 | 1/1992 | Collins et al. | 73/153 |
| 5,156,041 | 10/1992 | Schäper et al. | 73/38 |
| 5,167,139 | 12/1992 | Lafargue et al. | 73/38 |
| 5,168,927 | 12/1992 | Stegemeier et al. | 166/252 |
| 5,219,388 | 6/1993 | Meletiou et al. | 73/155 |
| 5,237,854 | 8/1993 | Jones | 73/38 |
| 5,261,267 | 11/1993 | Kamath et al. | 73/38 |
| 5,269,180 | 12/1993 | Dave et al. | 73/152 |
| 5,373,727 | 12/1994 | Heller et al. | 73/38 |
| 5,513,515 | 5/1996 | Mayer | 73/38 |

*Primary Examiner*—Michael Brock
*Assistant Examiner*—J. David Wiggins
*Attorney, Agent, or Firm*—Mark M. Friedman

[57] ABSTRACT

A method for quantitatively measuring the characteristic physical parameters of a porous medium, such as an aquifer that is initially recharged at a recharge rate and subsequently discharged at a discharge rate by a pumped fluid utilizing a single well into which a tracer is injected during recharge, and at which the tracer is subsequently detected during discharge. A measurement of the elapsed time, together with a formula based on a convective physical model relating the characteristic parameters to the time measurements is provided.

8 Claims, 3 Drawing Sheets

POROUS MEDIUM TEST WITH TRACER RECHARGING AND DISCHARGING THROUGH A SINGLE WELL

FIELD AND BACKGROUND OF THE INVENTION

The present invention relates to a method for quantitatively measuring a characteristic physical parameter of a porous fluid-bearing medium, such as an aquifer, involving its transmissivity, effective porosity, storativity, and drainable porosity. More particularly, it relates to a method for utilizing a single access point to the porous medium, such as a well, in conjunction with injections of a tracer substance and computations on measured flow rates and time intervals. The present application illustrates the use of this method to measure a characteristic parameter of an aquifer, but it will be appreciated that the method can also be applied to other types of porous fluid-bearing media, such as an oil reservoir.

A characteristic parameter of an aquifer may be expressed as $$b_c = \frac{s}{Tn_e m}$$

for a confined aquifer, and as $$b_p = \frac{n_a}{Tn_e m},$$

for a phreatic aquifer (related to a subterranean well). Here, m is the aquifer thickness (with dimensions of length); T is the transmissivity (with dimensions of area per time); and s is the storativity, $n_e$ is the effective porosity, and $n_a$ is the drainable porosity (all three of which are dimensionless quantities). Thus, both $b_c$ and $b_p$ have the dimensions of time per volume.

The present method is applicable to calculating the parameters $b_c$ and $b_p$ for single-layer as well as multi-layer aquifers. For multi-layer aquifers, the method can determine the parameters separately for each layer.

The characteristic parameters $b_c$ and $b_p$ may be used in combination with classical measurement techniques to obtain other parameters. For example, knowing m and $n_e$ in addition to $b_p$ yields the ratio $$\frac{n_a}{T}.$$

Aquifer parameters are currently computed from piezometric measurements, and measurements of water table level as a function of time and discharge rate. Tests based on such measurements, however, either do not yield values for all the parameters of interest, or they do not give accurate results. For example, they do not yield the effective porosity $n_e$, and the calculations by this test for storativity or drainable porosity are very uncertain.

Other current aquifer tests employ a tracer with two or more wells. The tracer is an inert substance that is injected instantaneously as a pulse into the water of the aquifer through one of the wells. It does not affect the physical properties of the water, but may be readily detected and measured, so that characteristic aquifer parameters may be measured by timing the transit of the tracer from one well to another as the aquifer is pumped. The drawback of such a method employing multiple wells, however, is that the duration of the test increases with the distance between the wells. To avoid extremely lengthy tests it is therefore necessary to have closely-spaced boreholes whose distance at the aquifer level is accurately known, and in practice this is difficult and expensive to achieve. In addition, this kind of test does not obtain all the parameters of interest, such as drainable porosity or storativity.

Given the problems and difficulties of these current test methods, it would be advantageous to have a method for measuring aquifer parameters which is simple to employ, and which would yield reliable values. These goals are attained by the present invention.

SUMMARY OF THE INVENTION

According to the present invention there is provided a method for measuring parameters of a porous medium, comprising the steps of: (a) providing a single access point to the porous medium; (b) recharging the porous medium through the access point at a recharge rate $Q_R$; (c) injecting a tracer pulse into the porous medium through the access point; (d) discharging the porous medium through the access point subsequent to the injecting at a discharge rate of $Q_D$, starting at an elapsed time $t_1$ after the injecting; (e) measuring a return time interval $t_2$ of the return of the tracer in the discharge during the period of the discharging; and (f) performing computations on results of the measuring to derive the parameters of the porous medium, the computations based on a convective physical model. According to the preferred embodiments of the present invention, a plurality of tracer injections and measurements improve the statistical confidence of the results of the method.

According to further features in the preferred embodiments of the invention described below, there is provided an analytical and a graphical form of presentation of the solution described below which relates the measured times and flow rates to the characteristic aquifer parameters.

The present successfully addresses the shortcomings of presently-known methods of measuring aquifer parameters by providing a method that is simple, easy, accurate, and inexpensive. The invention employs an improved physical model based on convection and is therefore able to make use of a single access point, such as a well, to the aquifer, instead of a set of wells, and thereby achieves economy, simplicity, and completeness in the measurement of parameters. It uses constant pumping rates, thereby simplifying monitoring and control. It further enables an aquifer test to be conducted in a reasonable period of time, thereby reducing the cost and delays associated with multiple-well tests, and preferably makes use of an existing well. The present invention thus attains the goal of a practical, simple aquifer test based on single-point tracer injection.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a test for quantitatively measuring the characteristic physical parameters of a porous fluid-bearing medium, such as an aquifer. Specifically, the present invention can be used to measure the characteristic parameters utilizing only a single access point, such as a well, to the aquifer.

Figure 3:
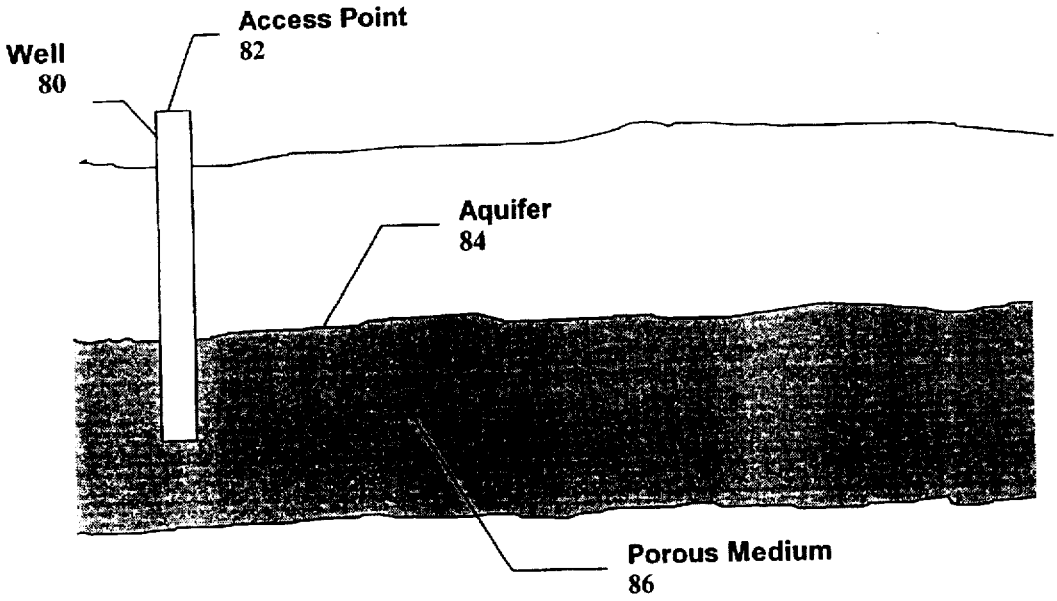
FIG. 3 is an illustration of a well, an access point, an aquifer, and a porous medium.

The principles and operation of the test according to the present invention may be better understood with reference to the drawings FIG. 3 illustrates an aquifer 84 with a porous medium 86, into which there is an access point 82 via a well 80 and the accompanying description.

Figure 1:
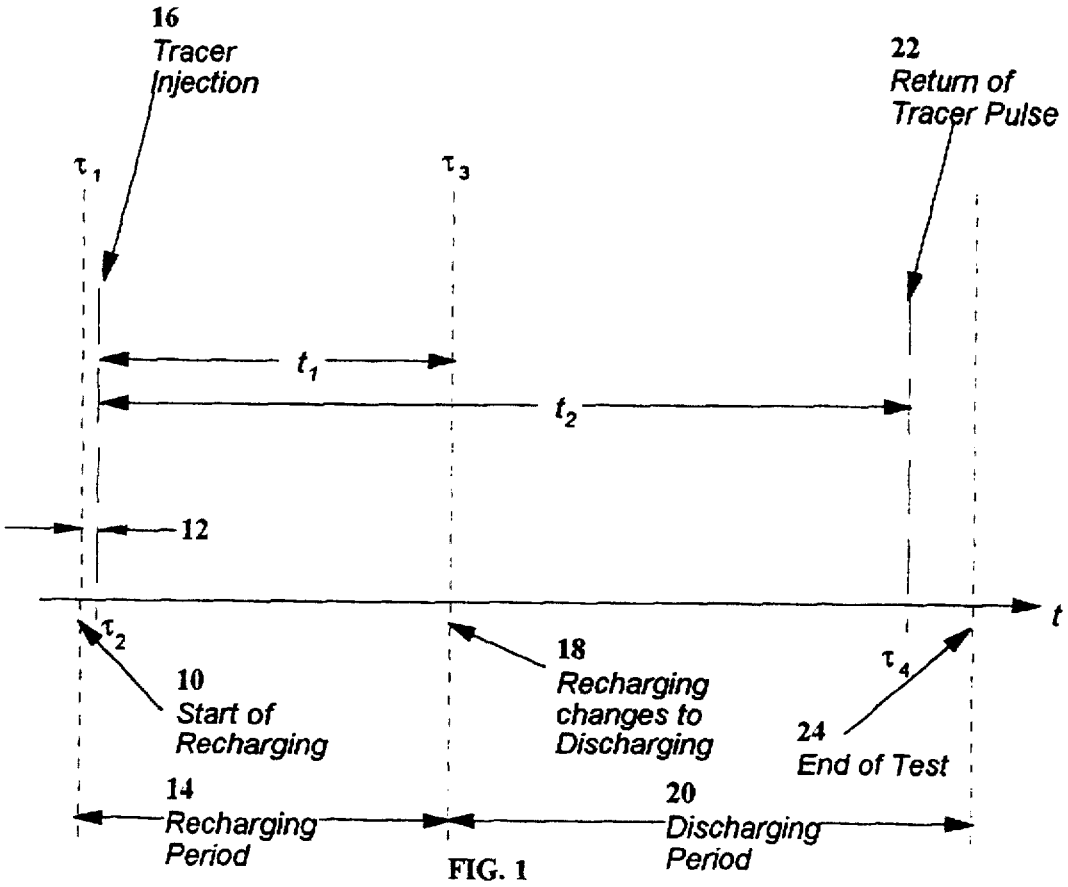
FIG. 1 is a graph illustrating the time sequence of events and the elapsed time variables for a test comprising one injection.

Referring now to the drawings, FIG. 1 illustrates a time sequence of the events and the elapsed time variables for a test comprising one tracer injection (time axis not to scale). In the embodiment of FIG. 1, recharging with rate $Q_R$ begins at time $\tau_1$, and when the pumping has reached a quasi steady state regime close to the well at time $\tau_2$, the tracer injection is made. Recharging proceeds for a further time $t_1$ at the constant rate $Q_R$.

When $t_1$ has elapsed, the next step is to make a change from recharging to discharging 18, in which the pumping is reversed to draw water out of the aquifer at a constant rate $Q_D$. During this step, the discharge water from the aquifer is monitored to detect the presence of the tracer, which returns to the access point as the discharge 20 proceeds. The tracer, which was originally concentrated at a single point in the aquifer at the time of the injection, will have dispersed with the water in the aquifer and will have spread out, but there exists a point 22 (usually the peak or weight center of the distribution) which moves convectively with the fluid velocity in the porous medium. When this point of the returning tracer is detected 22 at the access point at time $\tau_4$, the total elapsed time $t_2$ which has elapsed from injection 16 is recorded. It is $t_2$ which is measured in the test; all other quantities are selected by personnel conducting the test.

The time $t_1$ thus represents the amount of time the tracer was in the aquifer as it was being recharged, and the time $t_2-t_1$ represents the amount of time the tracer was in the aquifer as it was being discharged. The ratio of recharged and discharged total volumes $$z=\frac{Q_R t_1}{Q_D(t_2-t_1)}$$

is less than 1 and is a function of the applicable parameter $b_c$ or $b_p$.

The procedure for deriving the characteristic aquifer parameters $b_c$ and $b_p$ in terms of the volume ratio z is an innovative part of this invention. It was developed by analyzing a physical model based on convection and deriving the volume ratio $$z=\frac{Q_R t_1}{Q_D(t_2-t_1)}$$

in terms of the characteristic parameters of the aquifer. The solution to this was then inverted to obtain the characteristic parameters in terms of the volume ratio $$z=\frac{Q_R t_1}{Q_D(t_2-t_1)},$$

as is described below.

The analysis is based on the following assumptions:

(a) The aquifer is horizontal and of a finite uniform thickness. It is elastic, uniform, and isotropic. It is underlain by a plane impermeable layer.

(b) The access point penetrates down to the impermeable layer.

(c) The tracer is ideal. It is generally assumed that the movement of the traced point is convective only. Usually, this point is the peak or weight center of the tracer distribution.

The analysis begins with Theis' solution for a pumping well with fixed discharge rate, as is presented in *Principles of Water Percolation and Seepage*, by Bear, Zaslavsky, and Irmay, UNESCO, Paris, 1968:

$$H=H_0+\frac{Q}{4\pi T}\,Ei\left(-\frac{R^2}{4at}\right),$$

where the exponential integral $$Ei(-x)=-\int_x^{\infty}\frac{e^{-t}}{t}\,dt,$$

H is the piezometric head, R is the radial coordinate, Q is the discharge rate, $$a=\frac{T}{s}$$

in a confined aquifer and $$a=\frac{T}{n_e}$$

in a phreatic aquifer. By defining the material point velocity v and using Darcy's law we get:

$$v=\frac{dR}{dt}=\frac{-k}{n_e}\,gradH,$$

where $n_e$ is the effective porosity of the aquifer and $$k=\frac{T}{m}$$

is the conductivity.

As a result of axial symmetry, it is possible to get the identity grad $$H=\frac{dH}{dR},$$

which gives, after differentiation, $$\frac{dH}{dR}=\frac{Q}{4\pi T}\,\frac{d}{dR}\,Ei\left(-\frac{R^2}{4at}\right)=\frac{Q}{2R\pi T}\exp\left(-\frac{R^2}{4at}\right).$$

Then, defining $$c=\frac{kQ}{2\pi T n_e}$$

yields $$\frac{dR}{dt}=-\frac{c}{R}\exp\left(\frac{-R^2}{4at}\right).$$

The solution of this equation describes the tracer flow in terms of R(t), with initial conditions $R=R_0$ at t=0.

A simple solution of this equation can be found when $$\left(\frac{-R^2}{4at}\right)$$

remains small over considerable time. In this case the equation reduces to $$\frac{d(R^2)}{dt} = -2c,$$

which readily integrates to $$R^2 = R_0^2 - 2c(t - t_0).$$

This is the quasi steady-state solution.

For the non-steady state solution, we can obtain an approximate, but quite accurate, solution by introducing the quasi steady-state solution into the exponent of the previous equation:

$$\frac{dR^2}{dt} = 2c\exp\frac{-(R_0^2 - 2ct)}{4at} = -2c\exp\left(\frac{-R_0^2}{4at}\right)\exp\left(\frac{c}{2a}\right)$$

To integrate this, select the variable of integration as $$x = \frac{R_0^2}{4at}, \alpha = \frac{R_0^2}{4at'} \rightarrow dt' = \frac{-R_0^2}{4a\alpha^2}\,d\alpha,$$

which yields $$R^2 - R_0^2 = -2c\exp\left(\frac{c}{2a}\right)\int_{\infty}^{x}\left(\frac{-R_0^2}{4a}\right)\exp(-\alpha)\alpha^2 d\alpha$$

Integrating this last equation (see *Tables of Exponential Integrals*, by V. I. Pagurova, Mathematical Tables Series Volume 8, Perganon Press, 1961) gives $$R^2 = R_0^2 - 2ce^B E_2\left(\frac{R_0^2}{4at}\right),$$

where $E_2(x)$ is the incomplete Gamma function $$E_2(x) = \int_1^{\infty} e^{-xt}t^{-2}dt = x\Gamma(-1, x).$$

This solution gives the tracer location, R, as a function of time t in a non-steady-state potential field when the initial point is $R_0$ at t=0.

Tables and numerical methods of evaluating $E_2(x)$ are found in *The Handbook of Mathematical Functions* by Abramowitz and Segun, *Tables of Exponential Integrals*, by Pagurova, and it can also be evaluated with the use of mathematical software such as Mathcad, published by Math-Soft.

Returning to FIG. 1, the analysis of the convective model begins with recharging 10 of the aquifer at a constant rate $Q_R$. A quasi steady state is reached quickly, since the well radius r in $$\frac{r^2}{4at}$$

is small, and this expression characterizes the flow. At time $\tau_2$, a short pulse of the tracer is injected into the aquifer and begins to move away from the injection point. Recharging 14 continues until time $\tau_3$, where $\tau_3-\tau_2=t_1$. Then the flow reverses at a discharge rate of $Q_D$ until the tracer pulse returns at time $\tau_4$, where $\tau_4-\tau_2=t_2$. The reverse tracer flow is non-steady-state, especially at the start of the discharge, when the flow is reversed.

In *Principles of Water Percolation and Seepage*, by Bear, Zaslavsky, and Irmay, the solution for head distribution H due to varying rates $Q_R$ and $Q_D$ is given as follows:

$$H = \underbrace{H_0 - \frac{Q_R}{4\pi T}\ln\frac{r^2}{2.25at}}_{1} + \underbrace{He(t-t_1)\frac{1}{4\pi}Ei\left(-\frac{r^2}{4a(t-t_1)}\right)(Q_R + Q_D)}_{2},$$

where $He(t-t_1)$ is Heaviside's step function:

$$He(t-t_1) = \begin{cases} 1 \text{ if } t > t_1 \\ 0 \text{ if } t \leqq t_1 \end{cases}$$

The expression marked as 1 describes the initial quasi-steady-state character of the flow and the expression marked as 2 describes the later non-steady-state flow under pumping. Using Darcy's law again and differentiating for the velocity v gives $$v = \frac{dr}{dt} = -\frac{k}{n_e}\frac{dH}{dr} = \frac{c}{r} - \frac{c}{r}He(t-t_1)\left[\exp\left(\frac{-r^2}{4a(t-t_1)}\right)\left(1 + \frac{Q_D}{Q_R}\right)\right],$$

$$\text{where } c = \frac{Q_R k}{2\pi T n_e}.$$

Multiplying both sides of this equation by r and integrating gives $$\int_{r_0}^{r} d(r)^2 = 2c\int_0^t \left\{1 - He(t-t_1)\left[\exp\left(\frac{-r^2}{4a(t'-t_1)}\right)\left(1 + \frac{Q_D}{Q_R}\right)\right]\right\}dt',$$

where r=0 at t=0.

For a steady-state case, $$\left(\frac{-r^2}{4a(t-t_1)}\right)$$

remains small over considerable time, so the steady-state solution is $$r^2 = r_0^2 + 2ct_1 - 2c\frac{Q_D}{Q_R}(t - t_1),$$

where $r_0$ is the well radius. To obtain a solution for non-steady-state flow, this expression for $r^2$ is introduced into the exponent in the right-hand-side of the integrated equation:

$$\int_{r_0}^{r} d(r)^2 = 2c \int_0^t \{1 - He(t - t_1)\left[\exp\left(\frac{-\left(r_0^2 + 2ct_1 - 2c\frac{Q_D}{Q_R}(t - t_1)\right)}{4a(t - t_1)}\right)\left(1 + \frac{Q_D}{Q_R}\right)\right]\} dt'$$

and so $$r^2 = r_0^2 + 2c\{t - (1 + \frac{Q_D}{Q_R})\int_{t_1}^{t} \exp\left(2c\frac{Q_D}{4aQ_R}\right)\exp\left[-\frac{(r_0^2 + 2ct_1)}{4a(t - t_1)}\right] dt'\}$$

It is convenient to define the quantity $$B = \frac{Q_D b_c}{4\pi} \text{ or } B = \frac{Q_D b_p}{4\pi},$$

for confined or phreatic aquifer accordingly, where $Q_D$ is the constant discharge pumping rate, with dimensions of volume per time. Thus, B is a dimensionless quantity. For a given discharge pumping rate $Q_D$, to obtain the characteristic aquifer parameter $b_c$ or $b_p$ it is sufficient to obtain B, and so it is the quantity B which is calculated by this method. In terms of a and c, $$B = \frac{\mu c}{2a},$$

where the ratio $$\mu = \frac{Q_D}{Q_R},$$

with $Q_R$ the recharge pumping rate.

The greatest distance reached by the tracer from the injection point is $r_1$, where $$r_1^2 = r_0^2 + 2ct_1.$$

Rewriting the equation for $r^2$ in terms of B and μ gives $$r^2 = r_0^2 + 2c(t - (1 + \mu))e^B \int_{t_1}^{t} \exp\left(-\frac{r_1^2}{4a(t' - t_1)}\right) dt'$$

As before, referring to *Tables of Exponential Integrals*, by V. I. Pagurova allows evaluation of the integral $$\int_{t_1}^{t} \exp\left(-\frac{r_1^2}{4a(t' - t_1)}\right) dt' = (t - t_1)E_2\left(\frac{r_1^2}{4a(t - t_1)}\right),$$

where $E_2(x)$ is the incomplete Gamma function $$E_2(x) = \int_1^{\infty} e^{-xt} t^{-2} dt = x\Gamma(-1, x).$$

Thus $$r^2 = r_0^2 + 2c\left\{t - (1 + \mu)e^B(t - t_1)E_2\left(\frac{r_1^2}{4a(t - t_1)}\right)\right\}.$$

Returning briefly to FIG. 1, return of the tracer pulse 22 occurs at elapsed time $t_2$ after injection 16, so setting $r = r_0$ for $t = t_2$, $$2c\left\{t_2 - (1 + \mu)e^B(t_2 - t_1)E_2\left(\frac{r_1^2}{4a(t - t_1)}\right)\right\} = 0.$$

Defining $$z = \frac{t_1}{\mu(t_2 - t_1)}$$

and setting $r_0 \equiv 0$ gives $$\frac{z\mu + 1}{1 + \mu} = e^B E_2(Bz).$$

This formula, based on a conductive physical model, which relates B to the volume ratio $$z = \frac{t_1}{\mu(t_2 - t_1)}$$

is an innovative part of this invention.

The value of B may be solved in terms of z and μ by the use of mathematical software such as Mathcad by MathSoft. Alternatively, it may be obtained graphically by a chart, as illustrated in FIG. 2.

Figure 2:
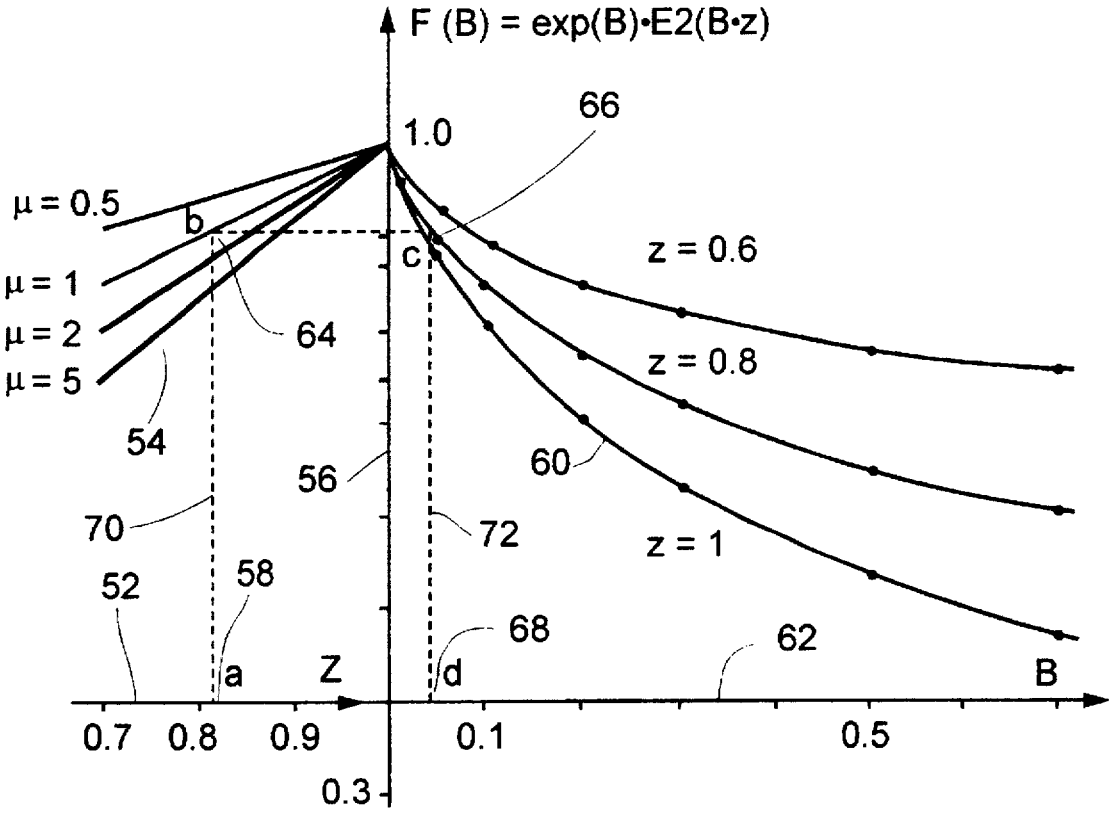
FIG. 2 is a graphical presentation of the characteristic parameters of an aquifer as a function of the test results.

The chart of FIG. 2, to which reference is now made, has two sets of expressions plotted. On the left is a family of straight lines 54 representing the linear function $$f(z) = \frac{z\mu + 1}{1 + \mu},$$

where $$z = \frac{t_1}{\mu(t_2 - t_1)},$$

involving the time ratio determined by the field test, and $$\mu = \frac{Q_D}{Q_R},$$

the ratio of the discharge pumping rate to the recharge pumping rate employed in the test. Plotted values of μ include 0.5, 1.0, 2.0, and 5.0. The left abscissa 52 corresponds to values of z, while ordinate 56 corresponds to f(z).

On the right is a family of curves 60 representing the function $$F(B,z) = e^B \int_1^{\infty} \frac{e^{-uBz}}{u^2} du$$

for values of z including 0.6, 0.8, and 1. Values and plots of these curves may be obtained through the use of mathematical software, such as Mathcad, published by MathSoft, and may also be obtained by computer through the numerical methods detailed for the solution of Fredholm integral equations in chapter 18 of *Numerical Recipes in C*, by Press, Teukolsky, Vetterling, and Flannery.

The right abscissa 62 corresponds to values of B, while ordinate 56 corresponds to F(B, z). Ordinate 56 employs the same scale for both f(z) and F(B, z). To solve the equation, the value of z derived from the field test is first located 58 on the left abscissa 52. In this example, z=0.81. Then vertical line 70 with intersection 64 of plot 54 for μ=1 is made. The value of μ equals 1 since for this example $Q_D=Q_R$. Intersection 64 just obtained is then carried over to the right side of the chart by a line parallel to abscissa 52, to intersection 66 with plot 60 of F(B, z) corresponding to the value of z, slightly to the left of the curve for z=0.8. From intersection point 66, vertical line 72 is dropped to the right abscissa 62, with intersection point 68, for a value of B≈0.045. The graphical construction has thereby solved the equation f(z)=F(B, z), since vertical lines 70 and 72 intersect their respective functions at the same height. From this value of B and the discharge rate $Q_D$, the aquifer's characteristic parameter may be readily calculated from $$\frac{s}{Tn_e m}=\frac{4\pi B}{Q_D}$$

for a confined aquifer and $$\frac{n_a}{Tn_e m}=\frac{4\pi B}{Q_D}$$

for a phreatic aquifer.

The test results can be verified by computer using a program which solves the differential equation of Boussinesq and computes piezometric heads and gradients at any point of the network. This program can solve only the direct problem, meaning that the aquifer characteristics are the input of the program and the localization of marked points as a function of time is the output data. The confirmation requires three steps:

1. Introduce the aquifer parameters into the program, simulate the test and obtain the return time of the pulse as an output;

2. Use the formula of the present method to obtain the aquifer characteristic B;

3. Compare this characteristic with the input parameter of the program.

The simulation refers to a single well recharged with rate $Q_R$=500 $m^3$/day in an aquifer with the following parameters: k=10 m/day; m=10 m; T=100 $m^2$/day; $n_a=n_e$=0.1. Ten minutes after well recharging starts the tracer pulse was injected and 30 hours after, the injection recharge was changed to discharge at the same rate. The pulse came back 67.1 hours after its injection.

From this experiment the following data was obtained:

1. As a first step the group parameter B in the program input was taken as:

$$B_{in}=\frac{c}{2a}=\frac{Qn_a}{4\pi Tmn_e}=\frac{500*0.1}{4\pi*100*10*0.1}\approx 0.040.$$

2. As a second step the aquifer group B was obtained from the program output using FIG. 2. The constants μ and z may be easily computed:

$$\mu=\frac{Q_D}{Q_R}=1,\ z=\frac{t_1}{t_2-t_1}=\frac{30}{37.1}=0.809.$$

Using these values of μ and z and FIG. 2, the value of group parameter $B_{out}\approx 0.045$ is obtained.

3. Comparison between $B_{in}$ and $B_{out}$ shows our error (δB) to be less than $$13\%:\ \delta B=\frac{B_{out}-B_{in}}{B_{in}}=\frac{0.045-0.04}{0.04}=0.125.$$

It is desirable to increase the discharge rate $Q_D$ relative to the recharge rate $Q_R$ in order to increase the value of B.

The present method is also applicable to multilayer aquifers. Here, the parameters and test quantities for layer j are denoted by subscript j.

In the case of a multilayer aquifer whose layers all have the same piezometric head H, the values of $Q_j$ and $s_j$ are common macroscopic values for the aquifer as a whole, and are denoted as $Q_0$ and $s_0$, respectively. For such a multilayer aquifer, the tracer moves differently in each layer. If a top layer is phreatic, for layer j:

$$B_j=\frac{Q_0}{4\pi T_0^2}*\frac{k_j n_a}{n_{ej}}.$$

If a top layer is confined, $s_0$ should be used instead of $n_a$:

$$B_j=\frac{Q_0}{4\pi T_0^2}*\frac{k_j s_0}{n_{ej}}.$$

For a multilayered aquifer where the layers are separated from each other and do not necessarily have the same piezometric head:

$$B_j=\frac{Q_j}{4\pi T_j m_j}*\frac{s_j}{n_{ej}},$$

where $\Sigma Q_j=Q_0$ and $\Sigma T_j=T_0$.

Until now there is no way to measure the $Q_j$ and $T_j$ separately for the different layers. But if it is assumed that the ratio $$\frac{Q_j}{T_j}$$

(and gradients) are the same for every layer, the problem is solvable.

While a single tracer injection is sufficient for the test, it will be appreciated by persons knowledgeable in the art that employing several such injections improves the statistical accuracy of the test by obtaining several readings.

While the invention has been described with respect to a limited number of embodiments, it will be appreciated by persons knowledgeable in the art that many variations, modifications and other applications of the invention may be made.

What is claimed is:

1. A method for measuring parameters of a porous medium, comprising the steps of:

(a) providing a single access point to the porous medium;

(b) recharging the porous medium through said access point at a recharge rate $Q_R$;

(c) injecting a tracer pulse into the porous medium through said access point;

(d) discharging the porous medium through said access point subsequent to said injecting at a discharge rate of $Q_D$, starting at an elapsed time $t_1$ after said step of injecting;

(e) measuring a return time interval $t_2$ of the return of said tracer in the discharge of said porous medium during the period of said discharging; and (f) performing computations on results of said measuring to derive the parameters of the porous medium, wherein deriving the parameters of said porous medium yields a solution for said tracer pulse injection and said discharging of porous medium, said computations based on a convective physical model characterized by an analytical formula of form $$\frac{z\mu+1}{1+\mu} = e^{B}\int e^{-uBz}u^{-2}du,$$

where:

(i) B is a quantity related to at least one porous medium parameter;

(ii) z is a quantity related to at least one of the time intervals $t_1$ and $t_2$; and (iii) μ is a quantity related to at least one of the rates $Q_R$ and $Q_D$.

2. The method as in claim 1, wherein said injecting is effected at a plurality of times.

3. The method as in claim 1 wherein $$B = \frac{Q_D s}{4\pi T n_e m},$$

wherein s is a storativity of the porous medium, T is a transmissivity of the porous medium, $n_e$ is an effective porosity of the porous medium, and m a thickness of the porous medium.

4. The method as in claim 1 wherein $$B = \frac{Q_D n_a}{4\pi T n_e m},$$

wherein $n_a$ is a drainable porosity of the porous medium, T is a transmissivity of the porous medium, $n_e$ is an effective porosity of the porous medium, and m a thickness of the porous medium.

5. The method as in claim 1, wherein $$z = \frac{t_1}{\mu(t_2 - t_1)}.$$

6. The method as in claim 5, wherein $$\mu = \frac{Q_D}{Q_R}.$$

7. The method as in claim 1, wherein $$\mu = \frac{Q_D}{Q_R}.$$

8. The method as in claim 1, wherein said solution is effected graphically.

* * * * *